US006098042A

United States Patent [19]

Huynh

[11] Patent Number: 6,098,042

[45] **Date of Patent: *Aug. 1, 2000**

[54] HOMOGRAPH FILTER FOR SPEECH SYNTHESIS SYSTEM

[75] Inventor: Duy Quoc Huynh, Cedar Park, Tex.

[73] Assignee: International Business Machines Corporation, Armonk, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 09/016,545

[22] Filed: Jan. 30, 1998

[51] Int. Cl.[7] ..... G10L 13/00

[52] U.S. Cl. ..... 704/260; 704/266

[58] Field of Search ..... 704/260, 266, 704/4

[56] References Cited

U.S. PATENT DOCUMENTS

| | | | |
|---|---|---|---|
| 3,704,345 | 11/1972 | Coker et al. . | |
| 4,706,212 | 11/1987 | Toma | 364/900 |
| 4,868,750 | 9/1989 | Kucera et al. | 364/419 |
| 4,887,212 | 12/1989 | Zamora et al. . | |
| 5,068,789 | 11/1991 | Van Viembergen . | |
| 5,146,405 | 9/1992 | Church . | |
| 5,157,759 | 10/1992 | Bachenko . | |
| 5,268,990 | 12/1993 | Cohen et al. . | |
| 5,317,673 | 5/1994 | Cohen et al. . | |
| 5,424,947 | 6/1995 | Nagao et al. . | |
| 5,455,889 | 10/1995 | Bahl et al. . | |
| 5,535,120 | 7/1996 | Chong et al. | 364/419.03 |
| 5,806,021 | 9/1998 | Chen et al. | 704/9 |
| 5,845,306 | 12/1998 | Schabes et al. | 707/532 |
| 5,893,901 | 4/1999 | Maki | 704/260 |

OTHER PUBLICATIONS

H. Nomiyama and S. Ogino, "Two–Pass Lexical Ambiguity Resolution", *IBM Technical Disclosure Bulletin,* Dec., 1991, vol. 34, No. 7A, pp. 149–153.

Victor W. Zue, "Toward Systems that Understand Spoken Language", *IEEE,* Feb. 1994, pp. 51–59.

"The Broad Study of Homograph Disambiguity for Mandarin Speech Synthesis"; Wang et al, Spoken Language, 1996 ICSLP 96, Oct. 3, 1996.

*Primary Examiner*—Krista Zele
*Assistant Examiner*—Michael N. Opsasnick
*Attorney, Agent, or Firm*—Kudirka & Jobse, LLP

[57] ABSTRACT

A homograph filter and method which increase the probability that homographs are pronounced correctly in a speech synthesis system utilizes a filter engine operating in conjunction with a set of rules. The filter engine parses a textual sentence to extract any present homographs and applies a correct set of rules to the homograph, based on an optimal search algorithm. The engine then carries out any appropriate substitution of phonetic data. Rules are primarily based on syntactic analisis, based on a priori knowledge of how each homograph is used. The rule set is classified into different categories in order to optimize the search algorithm and to allow the rules to be modified and updated incrementally without effecting the engine construction and/or performance. The search algorithm utilizes syntactic analysis to achieve optimum results. If syntactic analysis does not yield a satisfactory result, semantic analysis could also be utilized to determine the usage of the homograph based on the contents of the items which surround the homograph. The rule set contains a set of grammatical rules to perform syntactic analysis. If syntactic or semantic analysis does not yield a result, the result will be based on the statistical usage of the given homograph.

35 Claims, 11 Drawing Sheets

| Homograph | Phonetic #1 | Phonetic #2 |
|---|---|---|
| "address" | "<<~\\'@dr\\'Es>>", | "<<~\\-%dr\\'E\\'s>>, |
| "close" | "<<~Kl\\'oz>>", | "<<~Kl\\'os>>", |
| "lead" | "<<~l\\'id>>", | "<<~l\\'Ed>>", |
| "live" | "<<~l\\'Iv>>", | "<<~l\\'Yv>>", |
| "record" | "<<~r\\'EK\\-&d>>", | "<<~r\\-i K\\'c&d>>", |
| "wind" | "<<~w\\'Ind>>", | "<<~w\\'Ynd>>", |

FIGURE 3

Parts of Speech

| Homograph | Noun | Verb | Adjective | Past Participle |
|---|---|---|---|---|
| Address | * | * | | |
| Close | | * | * | |
| Lead | * | * | | * |
| Live | | * | * | |
| Record | * | * | | |
| Wind | * | * | | |

FIGURE 4A

| Attribute | Past Participle | Adjective | Noun | Verb |
|---|---|---|---|---|
| --NV | | | NV | VN |
| -AN- | | AN | NA | |
| -ANV | | AN AV | NV NA | VA VN |
| P-NV | (PN) (PV) | | NV (NP) | VP VN |
| -AV- | (PV) | AV | | VA |
| P--V | | | | P |

Note: P=past participle
A=adjective
N=noun
V=verb

FIGURE 4B

| Generic Rules | Homograph Rules | | | | | | | | | | | | | | | | |
|---|---|---|---|---|---|---|---|---|---|---|---|---|---|---|---|---|---|
| | SAN | SAV | SNV | SVA | SVN | CPV | CAN | CAV | CNA | CNV | CVA | CVN | PAN | PAV | PNV | PVA | PVN |
| IsDefArticle() | | X | X | | | | | | | X | | X | X | | | | |
| IsInDefArticle() | | | | | | | | | | | | X | | | | | |
| IsDemonstrative() | | X | | | | | | | | | | | X | | X | | |
| IsToBe() | | | X | | | | X | X | | X | | | X | | | | |
| IsToBeNot() | | | | | | | X | | | | | | | | | | |
| IsToBeNotCtract() | | | X | | | | X | | | X | | | X | | | | |
| IsToBeEquiv() | | | X | | | | X | X | | | | | X | | | | |
| IsToHave() | | | X | | | X | | | | X | | | X | | | | |
| IsToHaveNot() | | | | | | X | | | | | | | | | | | |
| IsToHaveNotCtract() | | | X | | | X | | | | X | | | X | | | | |
| IsToDo() | | | | | | | | | | X | | X | X | | | | |
| IsToDoNot() | | | | | | | | | | | | X | | | | | |
| IsToDoNotCtract() | | | | | | | | | | X | | X | X | | | | |
| IsPrepG1() | | | | | | | | | | X | | | | | | | |
| IsPrepG2() | | | | X | | | | | | | | | | | | | |
| IsPersPronoun() | | | | | | | X | | | | | X | X | | | | |
| IsPossessiveP() | | X | | | | | | | | X | | | | | | | |
| IsIndefPronounG1() | | | | | | | | | | X | | | | | X | | |
| IsIndefPronounG2() | | | | | | | | | | | | | | | X | | |
| IsImpIndObj() | | | X | | | | | | | | | X | | | | | |
| IsAux() | | | X | | | | | | | X | X | X | X | | | | |
| IsAuxNot() | | | | | | | | | | | X | X | | | | | |
| IsAuxNotCtract() | | | X | | | | | | | X | X | X | X | | | | |
| IsModifierG1() | | | | | | | X | X | | | | | | | | | |
| IsModifierG2() | | | | | | | | X | | | | | | | | | |
| IsModifierG3() | | | | | | | X | | | | | | | | | | |
| IsAdverb() | | | | | | | | | | | | | X | | | | |

S = Special
C = Certainty
P = Probable

P = Past Participle
A = Adjective
N = Noun
V = Verb

Example:
SAN = Special Adjective - Noun Rule

*FIG. 5B*

| Hexadecimal Representation | Homograph | Applicable Parts of Speech P A N V | Applicable Rules | Phonetic Usage Based On Rules P A N V | Phonetic Usage Based On Statistical Bit |
|---|---|---|---|---|---|
| 00303010 | address | 0 0 1 1 | C P | 0 0 0 1 | 0 |
| 50505040 | close | 0 1 0 1 | S C P | 0 1 0 0 | 0 |
| B0B0B080 | lead | 1 0 1 1 | S C P | 1 0 0 0 | 0 |
| 50505040 | live | 0 1 0 1 | S C P | 0 1 0 0 | 0 |
| 00303011 | record | 0 0 1 1 | C P | 0 0 0 1 | 1 |
| 30303010 | wind | 0 0 1 1 | S C P | 0 0 0 1 | 0 |

FIGURE 6B

HOMOGRAPH FILTER FOR SPEECH SYNTHESIS SYSTEM

FIELD OF THE INVENTION

The present invention relates, in general, to data processing systems, and more specifically, to a speech synthesis system capable of correctly pronouncing homographs.

BACKGROUND OF THE INVENTION

A homograph, as defined by Webster's Ninth New College Dictionary, is one of two or more words spelled alike but different in meaning or derivation and, sometimes having different pronunciation. For example, the word "bow" functions as a noun, meaning the front part of a ship, or, a decorative knot. The word "bow" also functions as a verb, meaning to bend. The noun and verb versions of the word "bow" have different pronunciations. Other examples of homographs which can function as either nouns or verbs with different pronunciations include words such as wind, defect, conduct, rebel, record, subject, etc. Generally, when reading text, the context of the text provides the reader with a basis for choosing the correct pronunciation of the homograph, however such a task is more difficult for speech synthesis systems.

Numerous advances have been achieved recently in speech synthesis technology, i.e., hardware and/or software capable of recreating the format and other vocal patterns required for intelligible human natural language. In particular, because of the large amount of memory required to store digitized speech, many computer based systems use text-to-speech conversion protocols. In these systems, the data to be synthesized is stored in binary form as text and, when necessary, converted to speech for presentation to listeners. Such systems reduce significantly the memory and overhead requirements in synthesizing speech. U.S. Pat. No. 3,704,345, Coker et al., discloses an early text-to-speech system. U.S. Pat. No. 5,157,759, Bachenko discloses a written language parser for a text-to-speech system used to provide properly placed pauses and emphasis in the synthesized words. In many synthesized speech systems homographs are generally ignored, with one pronunciation generated for all instances of a word regardless of the context. Some systems have attempted to alleviate the complexities created by homographs by using a full natural language parser. Unfortunately, the complexity of such a parser is not practical due to the memory and processing overhead required to execute the parser in conjunction with speech generation. Accordingly, a need exists for a method of increasing the probability the homographs are pronounced correctly within a speech synthesis system which may be implemented with as little programming code as possible. Further, a need exists for a means for increasing the probability that such homographs are pronounced correctly which does not significantly reduce the response time of the speech synthesis system. An additional need exists for a way to increase the probability the homographs are pronounced correctly in a speech synthesis environment which does not require significant amounts of system memory.

It is therefore an object of the present invention to provide a homograph filter which increases the probability of correctly pronouncing homographs in a speech synthesis environment which has both a fast response time and requires less code overhead and system memory.

SUMMARY OF INVENTION

The above and other objects are achieved with a homograph filter which increases the probability the homographs are pronounced correctly in a speech synthesis system. The homograph filter comprises a filter engine operating in conjunction with a set of rules. The filter engine parses a textual sentence to extract any present homographs and applies a correct set of rules to the homograph, based on an optimal search algorithm. The engine then carries out any appropriate substitution of phonetic data. The rule set is classified into different categories in order to optimize the search algorithm and to allow the rules to be modified and updated incrementally without effecting the engine construction and/or performance. The search algorithm utilizes syntactic analysis to achieve optimum results. If syntactic analysis does not yield a satisfactory result, then semantic analysis can be applied to analyze the contents of the items surrounding the homograph to determine its usage. The rule set comprises a set of grammatical rules to perform syntactic analysis. If syntactic or semantic analysis does not yield a result, the result will be based on the statistical usage of the homograph.

More specifically, the homograph filter retrieves a text sentence from the text database and copies it into a buffer. The sentence is parsed by the filter engine. In the illustrative embodiment, parsing is done by dividing the text into text segments delineated by punctuation characters. However, other parsing schemes may also be implemented. The filter engine examines each word in the text segment against the homograph list in the phonetic table and determines whether a homograph exists within that parsed segment of text. Ultimately, each word of the parsed sentence is compared with words in the homograph table. If a homograph exists, the engine also retrieves the words surrounding the homograph and applies rules to determine how the homograph is being used, i.e. as a past participle, adjective, noun, or verb. The rules are applied in accordance with the attributes associated with the homograph under test, found in the attribute table. Once the filter engine has determined the word usage for the homograph, the filter engine uses the attribute table entries to determine which phonetic code is appropriate for that usage of the given homograph. The phonetic code associated with that homograph is pulled from the phonetic table and inserted into the originally parsed text. The homograph filter passes the text string to the text-to-speech synthesis system. If a homograph is not found, the homograph filter copies the original word back into the text segment.

In accordance with one embodiment, the present invention discloses a computer program product for use with a computer system capable of converting text data into synthesized speech. The computer program product includes a computer useable medium having program code embodied in the medium for determining the correct pronunciation of homographs within the text data. The program code parses the text data into phrases and identifies any homographs within the phrases. Program code is further included for determining which homograph pronunciation is preferred, given the context of the homograph within the phrase, in accordance with a predetermined rule set. Program code is further included for substituting the homograph with phonetic data for the preferred pronunciation of the homograph.

In another embodiment of the invention, a method for increasing the probability that a homograph is pronounced correctly in a computer system capable of converting text data into synthesized speech includes the steps of parsing the text data into phrases, identifying homographs within the phrases, determining the preferred pronunciation of the homograph within the phrase in accordance with the predetermined rule, and substituting the homograph within the text data with data representing the preferred pronunciation of the homograph.

In yet another embodiment, the invention discloses a homograph filter apparatus for use with a computer system capable of converting text data into synthesized speech, the homograph filter containing apparatus for parsing the text data into phrases and identifying homographs within the phrases. Apparatus is further included for determining, in accordance with a predetermined rule set, which homograph pronunciation is preferred given the context of the homograph within the phrase, as well as apparatus for substituting the homograph in the text data with data indicating the preferred phonetic pronunciation.

In a further embodiment, the invention discloses a speech synthesis system having a processor, a memory for storing text data, a speech synthesizer coupled to an audio transducer for generating synthetic speech, and program code for converting the text data to phonetic data used by the speech synthesizer. The computer system further incudes a homograph filter operatively coupled between the program code means for converting the speech synthesizer for determining the preferred pronunciation of a homograph within the text data. The homograph filter comprising apparatus for parsing the text data into phrases and for identifying homographs within the phrases. The homograph filter further contains apparatus for determining which pronunciation of a homograph is more preferred in accordance with a predetermined rule set and, apparatus for substituting the homograph within the text data with phonetic data identifying the preferred pronunciation of the homograph.

BRIEF DESCRIPTION OF THE DRAWINGS

The above and other features, objects and advantages of the invention will be better understood by referring to the following detailed description in conjunction with the accompanying figures in which:

FIG. 3 illustrates a representative phonetic table in accordance with the invention;

FIG. 4A illustrates parts of speech for a representative list of homographs in accordance with the present invention;

FIG. 4B illustrates a homograph proposition pair table in accordance with the present invention;

FIG. 5B illustrates a mapping of homograph rules to generic rules in accordance with the illustrative embodiment of the present invention;

FIGS. 6A–B illustrate the format of the 32-bit attribute word and a representative attribute table, in accordance with the present invention;

DETAILED DESCRIPTION

Figure 1:
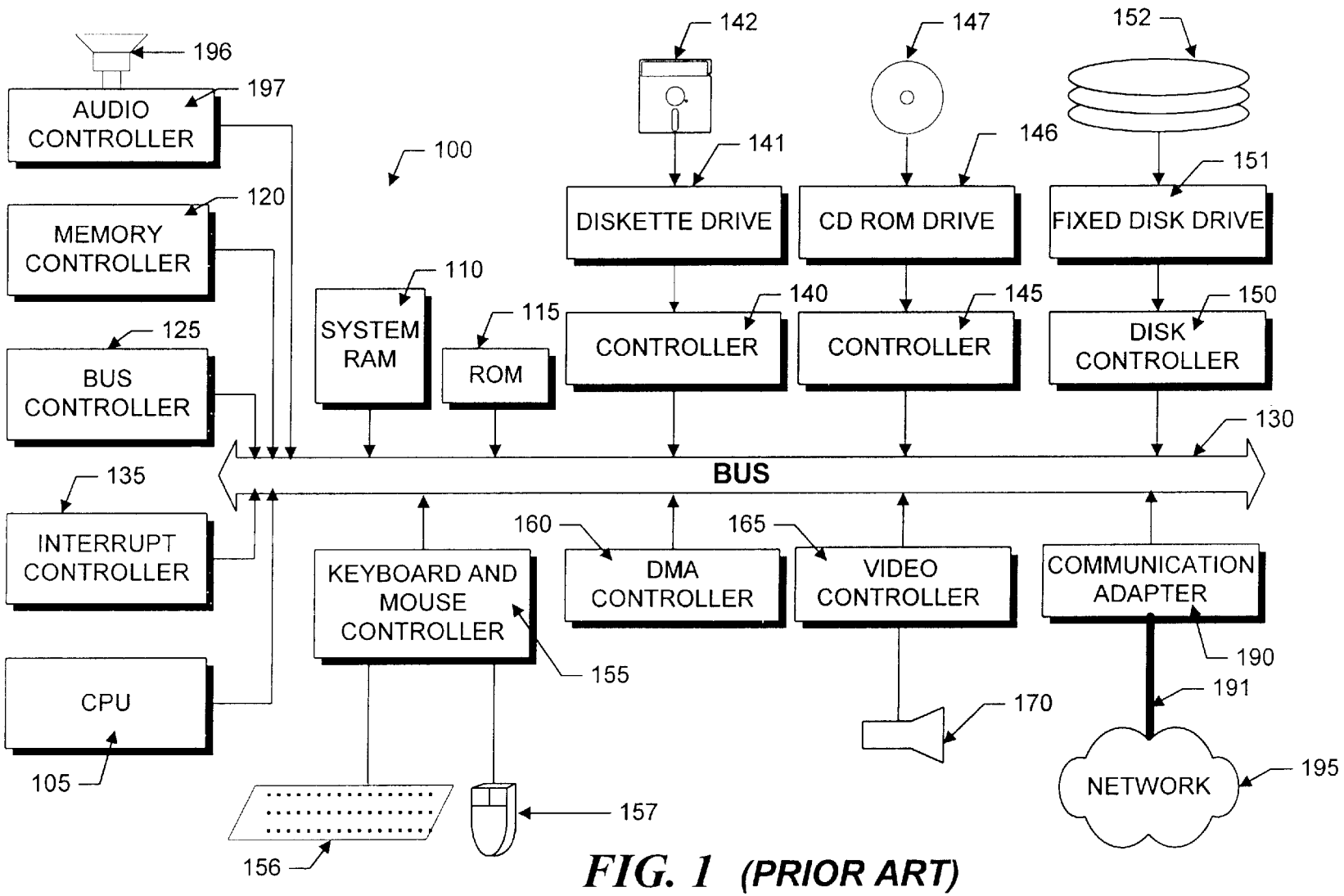
FIG. 1 (PRIOR ART)
FIG. 1 is a block diagram of a computer system suitable for use with the present invention.

FIG. 1 illustrates the system architecture for a computer system 100 such as an IBM PS/2®, on which the invention may be implemented. The exemplary computer system of FIG. 1 is for descriptive purposes only. Although the description may refer to terms commonly used in describing particular computer systems, such as in IBM PS/2 computer, the description and concepts equally apply to other systems, including systems having architectures dissimilar to FIG. 1.

Computer system 100 includes a central processing unit (CPU) 105, which may be implemented with a conventional microprocessor, a random access memory (RAM) 110 for temporary storage of information, and a read only memory (ROM) 115 for permanent storage of information. A memory controller 120 is provided for controlling RAM 110.

A bus 130 interconnects the components of computer system 100. A bus controller 125 is provided for controlling bus 130. An interrupt controller 135 is used for receiving and processing various interrupt signals from the system components.

Mass storage may be provided by diskette 142, CD ROM 147, or hard drive 152. Data and software may be exchanged with computer system 100 via removable media such as diskette 142 and CD ROM 147. Diskette 142 is insertable into diskette drive 141 which is, in turn, connected to bus 30 by a controller 140. Similarly, CD ROM 147 is insertable into CD ROM drive 146 which is, in turn, connected to bus 130 by controller 145. Hard disk 152 is part of a fixed disk drive 151 which is connected to bus 130 by controller 150.

User input to computer system 100 may be provided by a number of devices. For example, a keyboard 156 and mouse 157 are connected to bus 130 by controller 155. An audio transducer 196, which may act as both a microphone and a speaker, is connected to bus 130 by audio controller 197, as illustrated. It will be obvious to those reasonably skilled in the art that other input devices, such as a pen and/or tabloid may be connected to bus 130 and an appropriate controller and software, as required. DMA controller 160 is provided for performing direct memory access to RAM 110. A visual display is generated by video controller 165 which controls video display 170. Computer system 100 also includes a communications adaptor 190 which allows the system to be interconnected to a local area network (LAN) or a wide area network (WAN), schematically illustrated by bus 191 and network 195.

Operation of computer system 100 is generally controlled and coordinated by operating system software, such as the OS/2® operating system, available from International Business Machines Corporation, Boca Raton, Fla. The operating system controls allocation of system resources and performs tasks such as processing scheduling, memory management, networking, and I/O services, among other things.

Figure 2A:
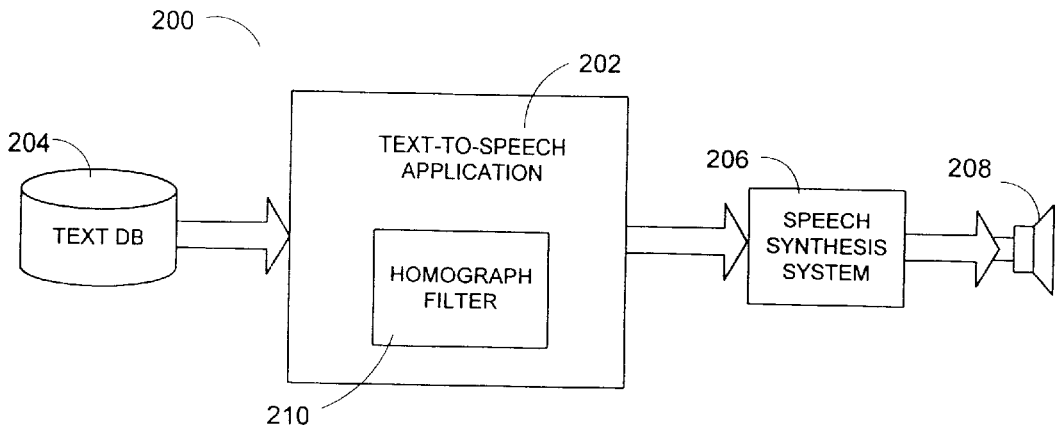
FIG. 2A is a conceptual block diagram of a text-to-speech system utilizing the homograph filter of the present invention.

FIG. 2A is a conceptual block diagram of a text-to-speech system 200 implementing a homographic filter in accordance with the present invention. System 200 comprises a text database 204, a text-to-speech application 202, a speech synthesis system 206, and a transducer, such as a speaker, 208. Homograph filter 210 is illustrated conceptually as part of text-to-speech application 202 but may function completely separate, in conjunction with a text-to-speech application. The structure and function of database 204, speech synthesis system 206 and speaker 208 are known within the relevant art and will not be described herein. In addition, text-to-speech applications are currently commercially available, such as those previously described.

Figure 2B:
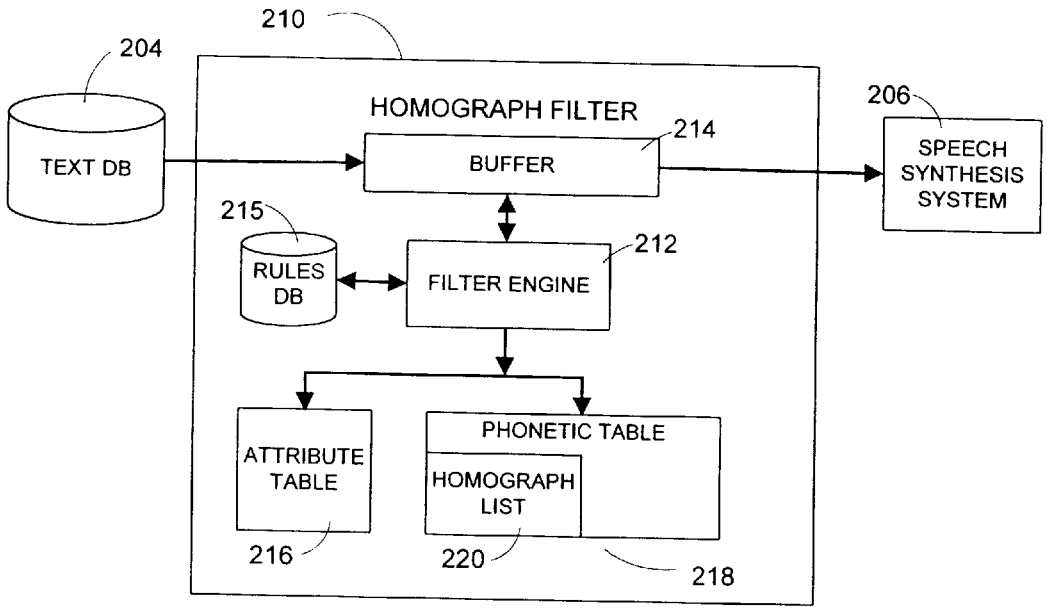
FIG. 2B is a conceptual block diagram of the homograph filter of the present invention.

Homograph filter 210 is illustrated conceptually in greater detail in FIG. 2B. Specifically, filter 210 comprises a filter engine 212, a buffer 214, a rule set 215, an attribute table 216 and a phonetic table 218, which includes a homograph list 220. In addition, text database 204 and speech synthesis system 206 are illustrated to show their relationship to homograph filter 210. In the illustrative embodiment, the homograph filter 210 is implemented in the C programming language. However, implementation of the instant invention could be accomplished using other software and hardware implementations. For example, an object oriented design language, such as C++ or Java, could also be used for the software implementaiton of the instant invention.

Referring FIG. 2B, the homograph filter 210 retrieves a text sentence from the text database 204 and copies it into a buffer 214. The sentence is parsed by the filter engine 212. In the illustrative embodiment, parsing is done by dividing the text into text segments delineated by punctuation characters. However, other parsing schemes may also be implemented. The filter engine 212 examines each word in the text segment against the homograph list 220 in the phonetic table 218 and determines whether a homograph exists within that parsed segment of text. Ultimately, each word of the parsed sentence is compared with words in the homograph table 220. If a homograph exists, the engine 212 also retrieves the words surrounding the homograph and applies rules to determine how the homograph is being used, i.e. as a past participle, adjective, noun, or verb. The rules are applied in accordance with the attributes associated with the homograph under test, found in the attribute table 216. Once the filter engine 212 has determined the word usage for the homograph, the filter engine 212 uses the attribute table 216 entries to determine which phonetic code is appropriate for that usage of the given homograph. The phonetic code associated with that homograph is pulled from the phonetic table 218 and inserted into the originally parsed text. The homograph filter 210 passes the text string to the text-to-speech synthesis system 206. If a homograph is not found, the homograph filter 210 copies the original word back into the text segment. The phonetic table 218, rules DB 215, attribute table 216, and filter engine 212 are discussed in more detail below.

FIG. 3 shows a phonetic table 218 in accordance with the illustrative embodiment. The phonetic table 218 is comprised of a homograph list 220 and two phonetic codes associated with each homograph. The homograph list 220 in the phonetic table 218 is used by the filter engine 212 to determine whether or not a parsed word is a homograph. Depending on the determination of the filter engine 212 regarding the usage of the homograph, based on application of the rules, one of the two phonetic representations will be inserted into the originally parsed text string in place of the original homograph. For example, for the homograph "wind", there are two phonetic representations shown in the phonetic table 218. The first representation or "phonetic #1", is for the noun form of the homograph "wind". The second phonetic representation is for the verb form of the word "wind". If, through application of the rules, its determined that "wind" is used as a noun, the filter engine 212 will substitute phonetic code #1 for the actual "wind" text in the original text string. In the illustrative embodiment, the phonetic codes have the form and content such that they can be recognized and used by the text-to-speech synthesis system 206 in combination with the homograph filter 210.

FIG. 4A is a representative list of the homographs and the associated parts of speech for which each homograph may be used. The filter engine 212 exploits the limitations on word usage for each homograph to reduce the number of rules to be applied to each homograph. For example, FIG. 4A shows that "address" can only be a noun or verb, "close" can only be a verb or adjective, and so on. The filter engine 212 will not apply a rule relating to adjectives or past participles when trying to determine the proper usage for the homograph "address", which can only be a verb or noun. The filter engine 212 employs the concept of "proposition pairs" to limit the application of homograph rules to a relevant rules subset and ultimately to determine the part of speech for which a homograph is being used.

FIG. 4B illustrates possible proposition pairs according to the illustrative embodiment. The phrase "proposition pair" refers to a grouping of two, or a pair of, possible parts of speech for a given homograph. For example, a proposition pair for "address" is noun-verb (NV) and another is verb-noun (VN). This concept of proposition pairs is embedded inherently in the rules to optimize searching. In fact, each homograph rule sets out the test to be applied to a given proposition pair. An attribute code, discussed below, is associated with each homograph, which informs the filter engine 212 as to which subset of rules to apply, given the possible proposition pairs for each homograph. Therefore, only rules applicable to a certain homograph are applied, thus minimizing the search time and processing.

In the illustrative embodiment, there are four different sets of homograph rules: noun, verb, adjective, and past participle. Each homograph rule in the set of rules relates to a proposition pair. For example, referring to FIG. 4B, there is a noun-verb (NV) rule within the noun set of homograph rules, as well as a noun-adjective (NA) rule and noun-preposition (NP) rule. Furthermore, there may be multiple homograph rules for a given proposition pair, such as NV, which relate to the likelihood a given homograph is used as a certain type of word or is used within a known combination of words. Consequently, each homograph rule within each set of homograph rules is further distinguished as being "special", "certainty", or "probable" rules. So, it's possible to have a special NV rule, a certainty NV rule, and a probable NV rule. These possibilities hold true for each rule set: noun, verb, adjective, and past participle. A "special" rule relates to a unique combination of a homograph and adjacent word, with a variety of tenses of the adjacent word possible. Satisfaction of a special rule yields an accurate determination of how a particular homograph is being used, e.g. "address" is used as a noun. A "certainty" rule has a more general application than a special rule, but when a homograph of a given speech type is paired with another type of word, application of the rule accurately identifies whether the homograph is a noun, verb, adjective, or past participle. A "probable" rule is similar to a certainty rule, but does not yield a definite result.

Figure 5A:
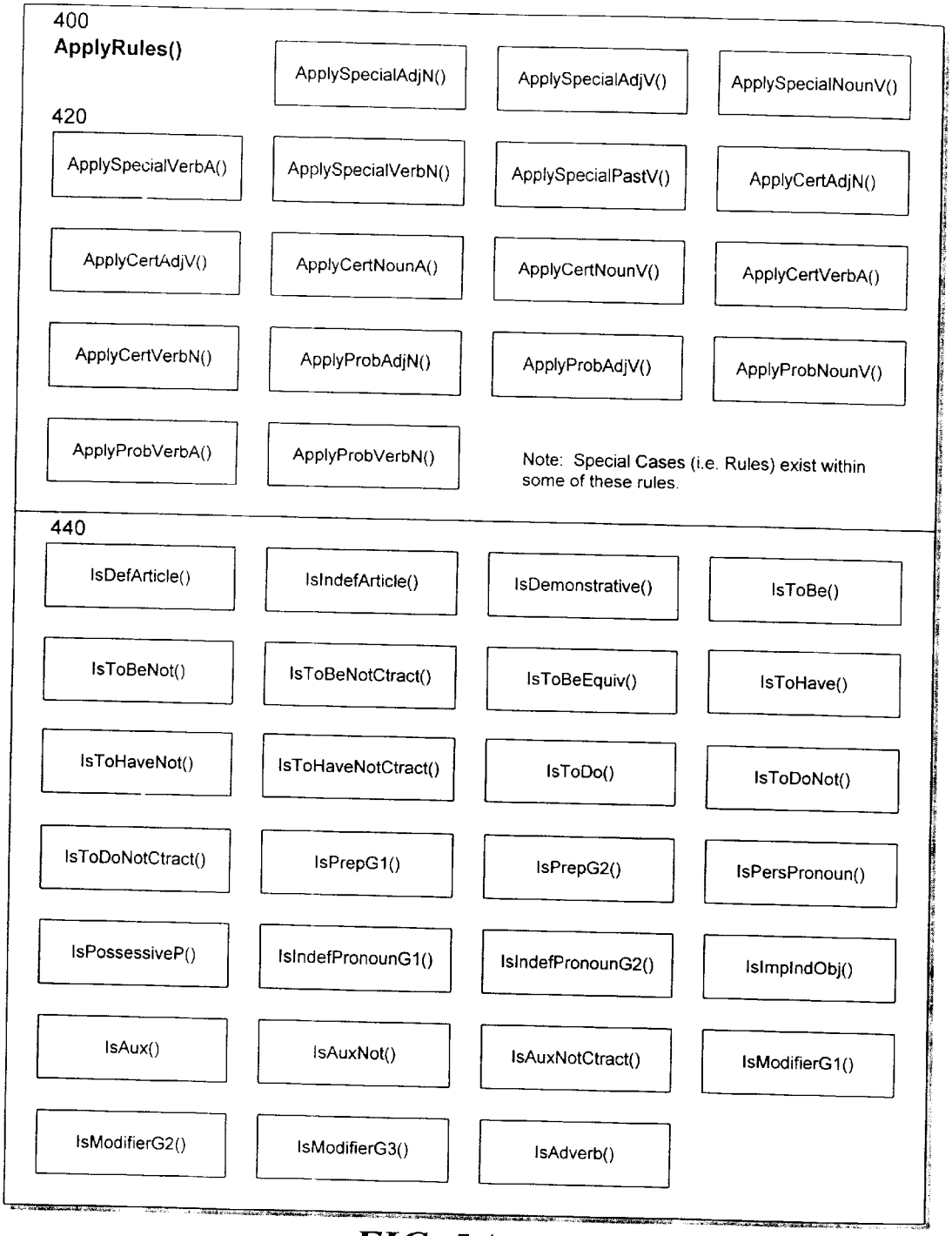
FIG. 5A illustrates the rules, depicted as software functions, in accordance with the present invention.

FIG. 5A shows all of the rules of the illustrative embodiment depicted as C language software functions. These rule functions are stored in the rules DB 215 and called and run by the filter engine 212. The top-level "Apply Ruleso" function 400 of the filter engine 212 calls the appropriate subset of homograph rules 420 for a homograph under test. As mentioned earlier, each homograph rule 420, is based on a proposition pair and is distinguished as being a special, certainty, or probable rule. Furthermore, in some instances special test "cases" comprise part of a homograph rule. For example, the ApplySpecialAdjV( ) function or rule includes a special test case to determine whether the preposition "from" follows the homograph "live". If so, "live" is being used as an adjective.

Beyond the homograph rules 420, there are generic rules 440 associated with the words surrounding the homograph.

The filter engine 212 runs the generic rule functions 440 to determine the word type of each of as many as two words preceding and following the homograph. In some cases, the engine 212 will search less than two words around the homograph, by design, and will not necessarily search words preceding and following the homograph. This tailoring is built into each rule based on a priori knowledge of how each homograph is used with other words. This scheme could easily be extended to analyze more than two words preceding and following the homograph under test for, perhaps, higher accuracy of the system. The filter engine 212 will not search beyond a punctuation mark for the surrounding words. For example, the filter engine 212 might try to determine whether the homograph is preceded by a personal pronoun or perhaps a form of the verb "to be", e.g. "am", "are", "is", "was", or "were". Analysis of the surrounding words helps determine the usage of the homograph. In the illustrative embodiment, the homograph rules 420 have embedded within them function calls to the relevant generic rules 440. For example, the "ApplySpecialAdjVo( )", i.e. special adjective-verb, rule calls the "IsDefArticle( )", i.e. is it a definite article, rule. A mapping of the generic rules 440 to those homograph rules 420 which call them is provided in FIG. 5B. Generic rules 440 can be called by multiple homograph rules or functions. For example, IsDefArticle( ) is also called by ApplySpecialNounV( ), ApplyCertNounV( ), ApplyCertVerbN( ), and ApplyProbAdjN( ). The application of generic rules 440 is not coded into the homograph attribute codes, unlike the application of the homograph rules 420 which is coded into the attribute codes.

It is significant that homograph rules are applied to a homograph under test in a deliberate manner to implement an optimal search based on a priori knowledge of the limited parts of speech that the homograph under test may assume. Accordingly, generic rules are also called by homograph rules in a deliberate manner to ensure that only relevant rules are used with a homograph under test. While FIG. 5B shows a mapping between homograph rules and generic rules for the illustrative embodiment, the rules could be modified or applied in a variety of ways to achieve substantially the same result as the instant invention.

An example of a homograph rule of the illustrative embodiment coded in the C programming language is as follows:

```
/*****************************************************/
/* FUNCTION:
   BOOL ApplyCertPastV (LPWCP IpWCB, LPRCB IpRCP,
   WORD Rule
   Number, LPINT IpMask)
PURPOSE:
   Apply either a specific or all certainty pastp-verb rules to a word.
*****************************************************/
BOOL ApplyCertPastV (LPWCP IpWCB, LPRCB IpRCP, WORD Rule
Number, LPINT IpMask)
{
BOOL TestAll,
   Result,
   GroupResult;
//init
   if (RuleNumber==0)              //test all rules
   {    TestAll = 1;
        RuleNumber = 1;            //start from lowest rule number
   }
   else
        TestAll = 0;               //test this specific rule only
        GroupResult = 0;           //RuleNumber = parameter passed
   //apply rules
```

-continued

```
      while((RuleNumber<=IpRCB->VMaxCertPastVRule) &&
  GroupResult!=-1)
      {                            //more rules to test, no certainty yet
          Result = 0;              //default value
          switch (RuleNumber)
          {
          case 1:
          //W{pastp,verb} & [to have conjugate, W]=>W{pastp}
          if(IsToHave (IpWCB->OnePre)
                || IsToHaveNot(IpWCB->TwoPre, IpWCB->OnePre)
                || IsToHaveNotCtract (IpWCB->OnePre))
                Result = -1;       //rule asserted
          break;                   //end case 1
          case 2:
          //W{pastp,verb} & [{he,she,it}W]
          & W{singular}=>W{pastp}
          if(!*IpWCB->sEnding &&
              (!strcmp ("he", IpWCB->OnePre)
              || !strcmp ("she",IpWCB->OnePre)))
                                   Result = -1 //rule asserted
          break;                   //end case 2
      }                            //end switch
      GroupResult = GroupResult + Result;
      if(TestAll)                  //test the next rule if test all true
      RuleNumber++;
  }                                // end while
  return (GroupResult);
}                                  // end function
```

This example illustrates the homograph rule 420 "ApplyCertPastV( )", with calls to the generic rules 440 "IsToHave( )", "IsToHaveNot( )", and "IsToHaveNotCtract( )" and two special test cases. The C language coding for the generic rule "IsToHave( )" follows, for illustrative purposes.

```
/*****************************************************/
/* FUNCTION:
    BOOL IsToHave (LPSTR String)
PURPOSE: Assert whether word is a conjugated form of the verb to have
    (i.e. have, has, had). Return true if so.
*****************************************************/
BOOL IsToHave (LPSTR String)
{
    if(! strcmp (String, "have")
    || !strcmp (String, "has") || !strcmp(String, "had"))
            return (1);                //match found
    else
            return (0)
    }                                  //end function
```

The homograph rules 420 and generic rules 440 are stored in the rule DB 215 and accessed by the filter engine 212 according to the coding of the attribute code for a homograph under test.

A summary of each homograph and generic rule is provided near the close of the this section. In light of the functional descriptions of the rules illustrated in FIG. 5A, the Rule Summaries, and the code examples contained herein, the actual coding of each rule module to perform the specified functions associated therewith is within the scope of those skilled in the programming arts.

Figure 6A:
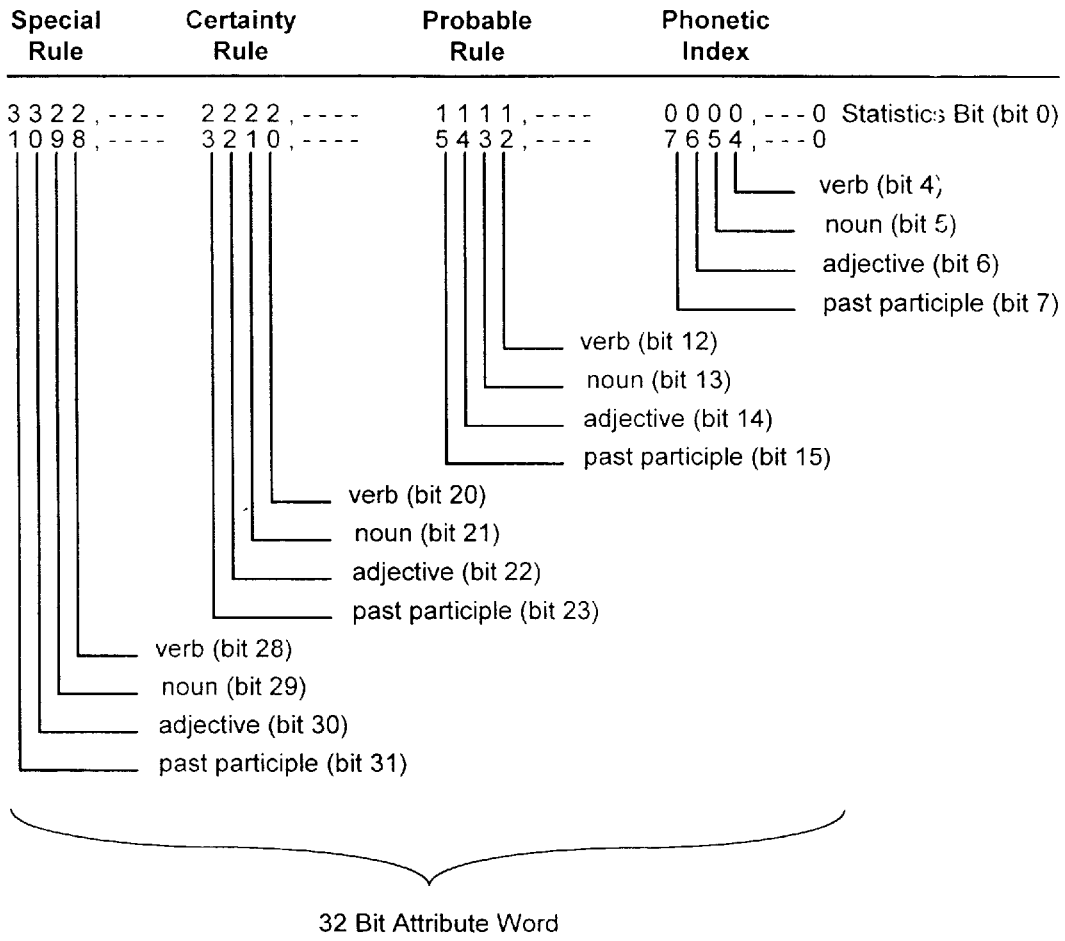

The structure of the 32-bit attribute code assigned to each homograph is shown in FIG. 6A. The attribute code denotes the part of speech, i.e. verb, noun, adjective or past participle, a given homograph can assume and the applicable rules, i.e. special, certainty, or probable, to be applied to a particular homograph under test. The attribute also incorporates a phonetic index associated with the pronunciation of the homograph. As discussed earlier, the phonetic index relates to the possible pronunciations of the homograph, depending on the rule determined usage of the homograph. Finally, the attribute code includes a statistics bit. If through application of the rules, the filter engine 212 is not able to determine the certain or probable pronunciation of the homograph, the filter engine 212 relies on the statistics bit to determine the statistically probable pronunciation of the homograph.

FIG. 6B shows an attribute table 216 in accordance with the illustrative embodiment for a representative sample of homographs. The 32-bit attribute code is represented in an 8-bit hexadecimal attribute code, with the right most bit being the least significant bit. The least significant bit, i.e. "statistics bit", in the right hand Phonetic Usage Based On Statistics Bit column, corresponds to the pronunciation of the homograph based on statistical usage. If the statistics bit is "0", the engine 212 will use the "Phonetic #1" representation for the homograph, as shown in FIG. 3. If the statistics bit is "1", the engine 212 will use the "Phonetic #2" representation.

Again referring to FIG. 6B, the second bit of the 8-bit hexadecimal attribute code corresponds to a 4-bit binary word representing "Phonetic Usage Based On Rules", i.e. "phonetic usage word". If the 4-bit binary phonetic usage word is "0001", as with "address", a "1" appears as the second bit of the 8-bit hexadecimal attribute code. The phonetic usage word is also directly related to the "Applicable Parts of Speech" 4-bit binary code. That is, if a homograph rule is satisfied, the 4-bit binary phonetic usage word indicates which phonetic code from the phonetic table, FIG. 3, will be used for a homograph given the determined word usage for the homograph. But, possible word usages are limited, as indicated by entries in the Applicable Parts of Speech column. For example, the word "address" can take on the applicable parts of speech of a noun (N), or verb (V), but not an adjective (A) or past participle (P), as indicated by the "1" under each "N" and "V" heading and a "0" under the "P" and "A" headings. This yields a 4-bit binary word of "0011" in the Applicable Parts of Speech column. The 4-bit binary word for phonetic usage also indicates a bit associated with P, A, N and V, which is "0001" for "address", although the bits associated with the "P" and "A" are meaningless for "address". Therefore, if "address" is used as a verb the "1" under V in the Phonetic Usage Based on Rules column indicates that the Phonetic #2 code from the phonetic table of FIG. 3 will be used. A "0" under the N indicates that the Phonetic #1 code will be used if "address" is determined to be used as a noun.

Referring to the "Applicable Rules" column of FIG. 6B, "SCP" refers to the first, second, and third bit of a 4-bit binary word, with the fourth, most significant bit, of the 4-bit word unused. The Applicable Rules column 4-bit binary word represents whether the special, certainty, or probable homograph rules must be applied by the filter engine 212 for the given homograph. Again, for the homograph "address", "CP" equates to "0011" which equals 3. Referring to the 8-bit hexadecimal attribute code, accordingly bits 4 and 6 are shown to be "3". Had there been an S in the applicable rules column for "address" also, there would have been a "3" in the 8th bit of the hexadecimal representation of the attribute code. This is shown in the representation of the word "close", where a "5" appears as the 4th, 6th and 8th bits. In this way, the applicable homograph rules are encoded into the attribute code for each homograph. Bits 3, 5, and 7 of the 8-bit hexadecimal attribute code remain "0" and are unused.

Figure 7:
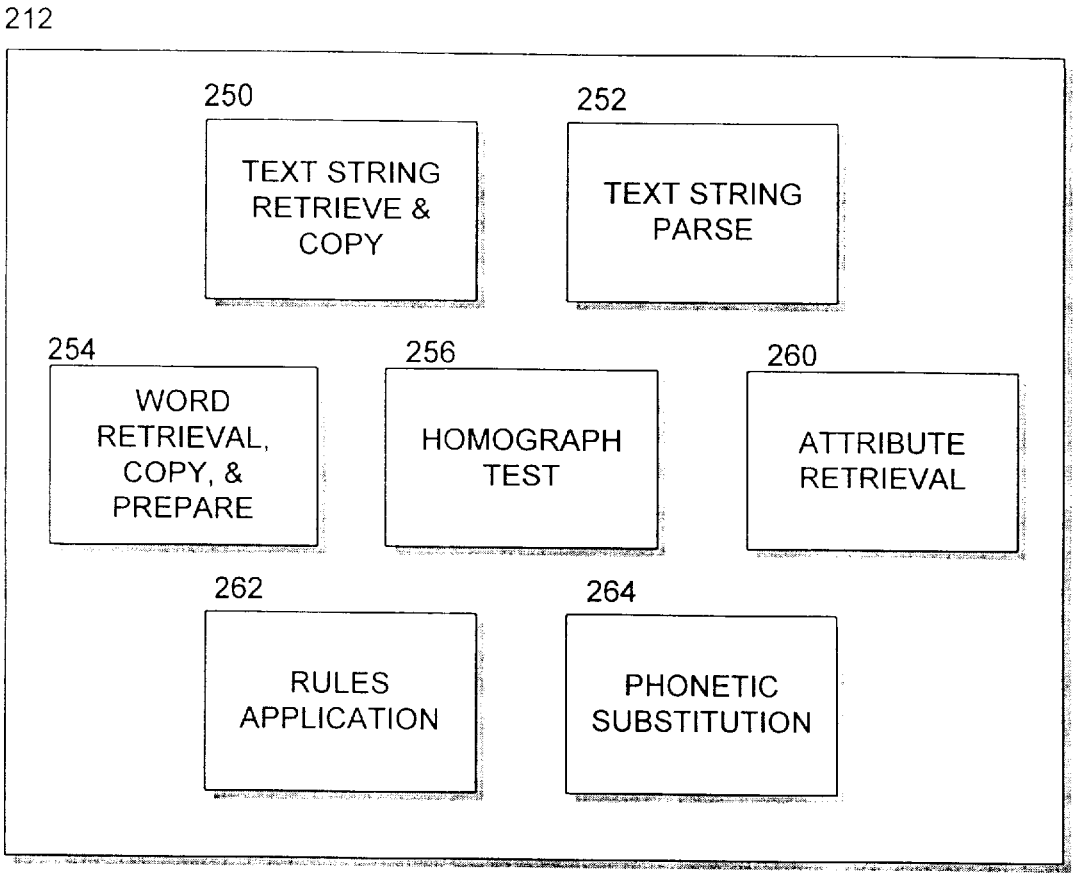
FIG. 7 illustrates a functional decomposition of the filter engine, in accordance with the present invention.

As shown in FIG. 7, filter engine 212 can be decomposed into the following functions: text string retrieve and copy 250, text string parse 252, word retrieve, copy, and prepare 254, homograph test 256, attribute retrieval 260, rules application 262, and phonetic substitution 264. This is a notional functional composition used to represent the basic functional elements of the filter engine, but the actual software coding of the functions need not be segmented into these specific functional modules. In the text string retrieve and copy function 250, the filter engine 212 goes into a text database 204 or "clipboard" maintained by the computer's 100 operating system and copies a text segment into a homograph filter buffer 214. In the text string parse function 252, the filter engine 212 operates on the text string stored in the buffer 214 by parsing it into text segments, delineated at punctuation marks. Once parsing has been completed, the word retrieval, copy, and prepare function 254 operates by using a "NextWord( )" function to copy in the first, and subsequently the next, word in the segment to be tested into a variable, called "word" in the illustrative embodiment. This function also strips any plurality or past tense from the word to be tested. The filter engine 212 then conducts a homograph test 256, by comparing the variable "word" against each homograph 220 listed in the phonetic table 218 using a function called "MatchWord( )". If there is a match, the word under test is a homograph, the word retrieval, copy, and prepare function 254 proceeds to copy the two words preceding and following the homograph using its "GetOnePre( )", "GetTwoPre( )", "GetOnePost( )", and "GetTwoPost( )" functions. While the illustrative embodiment analyzes, at most, the two words preceding and following the homograph, more words could also be analyzed if desired. If any of these functions reach a punctuation mark the function stops, since the filter engine 212 assumes that the relationship between a word separated from the homograph by punctuation is not necessarily useful in determining the usage of the homograph. The preceding and following two words are stripped of plurality and past tense, if any, to prepare them for use with the rules. Next, the attribute retrieval function 260 obtains the attribute code for the given homograph from the attribute table 6B. The filter engine 212 uses the rules application function 262 to apply all relevant rules 420, 440 associated with the homograph under test, which is referred to as syntactic analysis. If application of the rules yields satisfaction of a special, certainty, or probable rule, the filter engine 212 uses the phonetic usage portion of the attribute code to retrieve the appropriate phonetic code from the phonetic table 218. This functionality is coded in a separate routine called "GetPhoneIndex( )". If none of the syntactic-based rules are satisfied, then syntactic analysis has failed. Consequently, the filter engine 212 could then apply semantic analysis, which is another rule based analysis which focues on the contents, e.g. punctuation, numbers, and words, surrounding the homograph to determine how a given homograph is being used. Ultimately, if the application of rule based analysis has not yielded a satisfactory result, a result will be arrived at based on statistical probability by retrieving the statistical usage bit from the attribute code and retrieving the related phonetic code from the phonetic table 218. In either case, once the phonetic code is obtained, the filter engine 212, in the phonetic substitution function 264, replaces the original text with the phonetic code. If a homograph was never found the filter engine 212 copies the original text back into the text segment.

Figure 8A:
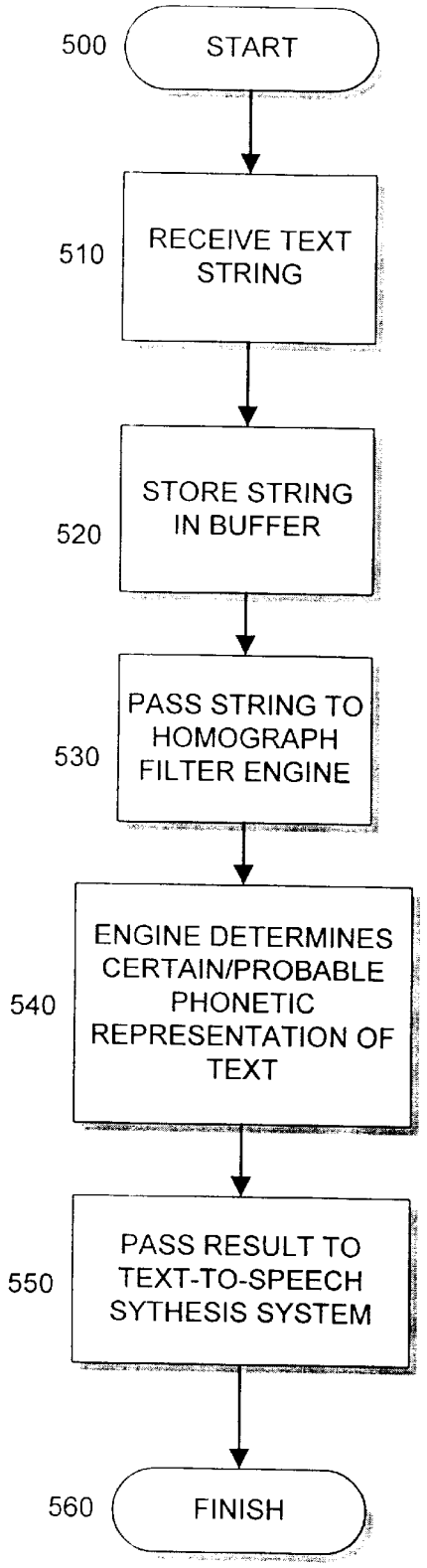
FIG. 8A is a flowchart illustrating the process steps performed by the filter engine in accordance with the method aspect of the present invention.

FIG. 8A shows the inventive method steps for determining the proper pronunciation of a homograph and converting the text homograph into synthesized speech. In the preferred embodiment, the homograph filter 210 is used in conjunction with a text database 204 and a speech synthesis system 206 to convert text into audio. In the first step 500, the process is started by having the computer running and text available in the text database. In the second step 510, a text string is received by the homograph filter 210 from the text database 204. In step 520, this string is stored in a buffer by the homograph filter for use by the filter engine 212. The homograph filter, in step 530, passes the string to the filter engine 212. In step 540, the filter engine 212 determines the certain, or at least most probable, phonetic representation of the text. This determination is made by the filter engine 212 through the application of a prioritized set of rules associated with each homograph, as is discussed more fully below and illustrated in FIG. 5B. Once the filter engine 212 has determined the proper phonetic representation of the homograph, the homograph filter 210, in step 550, inserts the phonetic code into the original text string where the homograph was originally located. The homograph filter 210 then passes the text string to the speech synthesis system 206. This completes the method of the preferred embodiment as shown in step 560.

Figure 8B:
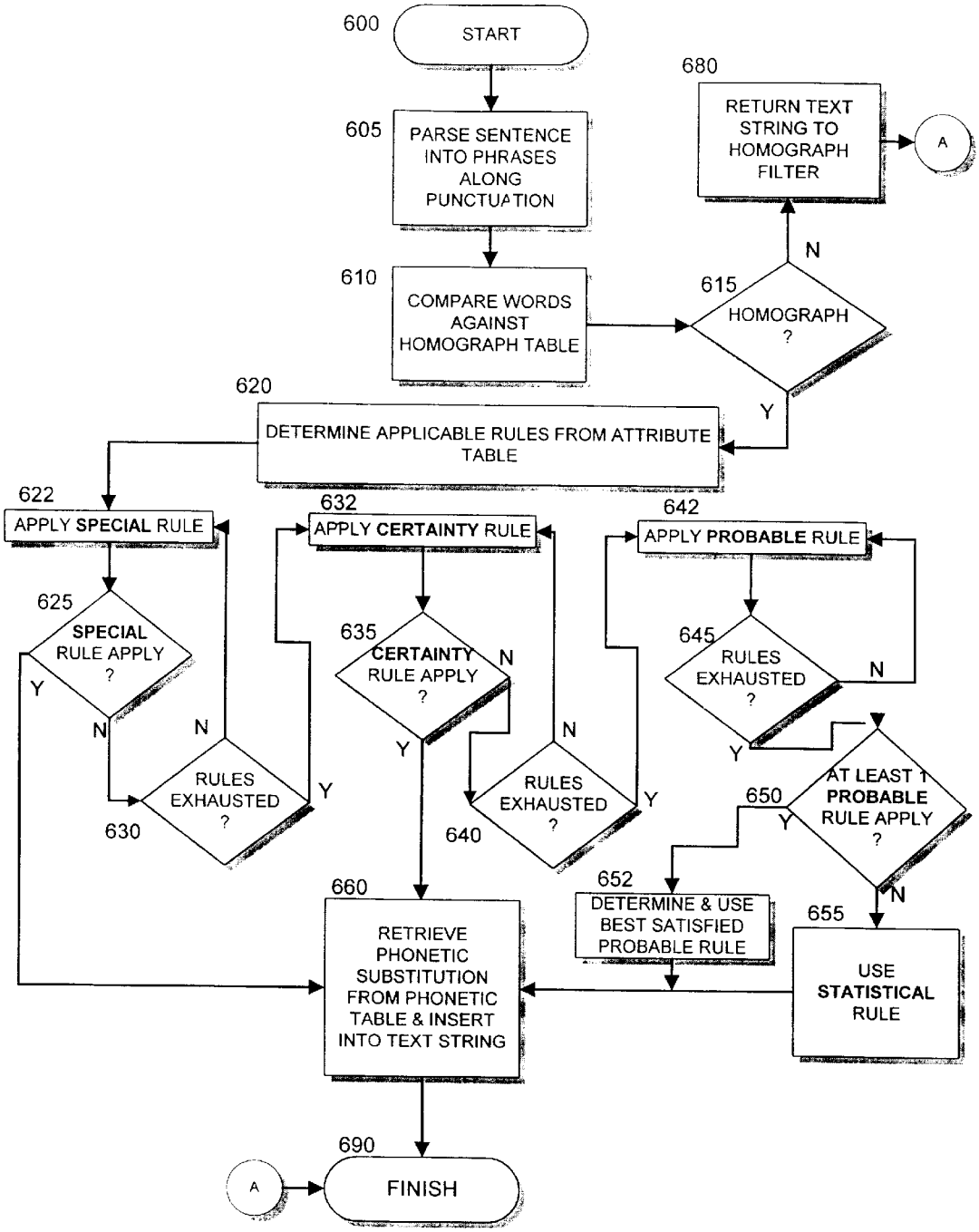
FIG. 8B is a flowchart illustrating the process steps performed by the homograph filter in accordance with the method aspect of the present invention.

FIG. 8B illustrates the method employed by the filter engine 212 to accomplish the method shown in step 540 of FIG. 5A. In step 605, the filter engine 212 parses the received text string into segments. In the illustrative embodiment, the parsing into phrases is done using punctuation characters as delineaters, as described previously. In step 610, the filter engine 212 compares words in the text string against a predefined homograph table. If the filter engine 212 determines in step 615 that a homograph exists in the parsed text string, the filter engine 212 proceeds to determine the correct or at least most probable phonetic representation of the homograph. According to step 615, if a homograph does not exist in the text string, the parsed text string is returned to the homograph filter 210 in step 680. At this point the operation of filter engine 212 would be complete, as shown in step 690. If there is a homograph in the text string, the engine 212 determines, based on an attribute code, the applicable rules for that homograph. Rules will be pulled from the rules database according to the following priority: special rules, certainty rules, and probable rules. As discussed earlier, the rules relate to all possible proposition pairs for each homograph. Coding of the 32-bit attribute word inherently identifies which rules the filter engine 212 will apply and the possible phonetic codes associated with the given homograph. To optimize the search, a priori knowledge of the limited possible usages for each homograph is reflected in the attribute code via the limitation on proposition pairs associated with each homograph. In applying a rule, the filter engine 212 looks at the possible usage of the homograph, e.g. noun, and the words adjacent to the homograph. Application of rules is tailored, by the coding of the attribute code, for each homograph to ensure an optimal search, with no wasted processing by the computer 100 from applying, for example, a verb rule to a homograph that can never be used as a verb. Application of the special, certainty, and probable rules is the syntactic analysis referred to earlier. Because there are fewer special rules than any other type, satisfaction of a special rule will result in the least amount of processing time. Therefore, the filter engine 212 will apply special rules in step 622, if any, first. In step 625 the filter engine 212 determines if the first applicable special rule is satisfied. If so, the filter engine 212 proceeds to step 660, where the appropriate phonetic representation is retrieved from the phonetic table of FIG. 4E. If the analysis in step 625 showed that the applicable special rule was not satisfied, the filter engine 212 determines whether there are remaining applicable special rules, in step 630. If there is another applicable special rule, the filter engine 212 proceeds back to step 622 and applies the next special rule, as discussed above. If no special rule has been satisfied and all special rules are exhausted, the filter engine 212 proceeds from step 630 to step 632, where the filter engine 212 applies the first applicable certainty rule, according to the coding of that homograph's 32-bit attribute word. As with the special rules, the filter engine 212 determines whether the certainty rule is satisfied in step 635. If so, the filter engine 212 proceeds to step 660. If not, the filter engine 212 proceeds to step 640 and determines whether there are any remaining certainty rules to apply. If there are remaining certainty rules, the filter engine 212 proceeds back to step 632 and determines whether the next certainty rule is satisfied, as before. If no certainty rule has been satisfied and all certainty rules are exhausted, the filter engine 212 proceeds to apply the first applicable probable rule in step 642. Regardless of whether the applied probable rule was satisfied, the filter engine 212 determines in step 645 whether all probable rules have been exhausted. The filter engine 212 will apply all applicable probable rules, regardless of how many are satisfied. In step 650 the filter engine 212 will determine whether at least one probable rule was satisfied. In the illustrative embodiment, if no probable rules were satisfied, the filter engine 212 will use the statistical rule in step 655, based on the statistics bit in the 32-bit attribute word, and choose the most likely usage, e.g. noun, of the homograph given the words adjacent to it in the parsed text. The filter engine 212 will proceed from step 655 to step 660 and insert the appropriate phonetic code for the homograph, e.g. "noun" phonetic code for the homograph. If, in step 650, the filter engine 212 determined that more than one probable rule was satisfied, the engine 212 will proceed to step 652 and determine, based on weighting of the probable rules, which rule was best satisfied and, therefore, which satisfied rule will most likely yield the proper usage of the homograph. The filter engine 212 will then proceed from step 652 to step 660 and retrieve the phonetic code to be substituted from the phonetic table and insert the phonetic code into the originally parsed text in place of the homograph. The filter engine process is then complete, as shown in step 690. The homograph filter 210 then begins processing again at step 550 of FIG. 8A.

Summary of Rules

As discussed earlier, there are two types of rules which are coded, in the illustrative embodiment, as C functions. They are generic rules 440 and homograph rules 420. These functions, implementing rules, are summarized below. The generic rule functions are discussed first and then the homograph rule functions, which call the generic rule functions, are discussed. FIG. 5B shows the mapping of generic rules to homograph rules in the illustrative embodiment, but the rules could be modified and, possibly applied in different ways, to achieve substantially the same result as disclosed herein.

Generic Rules

The naming conventions for each generic rule function is comprised of two parts. First, the word "Is" is used to indicate that the function implements a true or false type of test. Next, appended to "Is", is a text segment identifying the part of speech for which the function tests. Other naming conventions may also be used. If the test implemented by the function is satisfied, the function returns a "1" indicating "true", else the function returns a "0" indicating "false".

IsDefArticle( ) is called to determine whether the word passed to it is a definite article. That is, is the word passed "a", "an", or "the"?

IsIndefArticle( ) is called to determine whether the word to it is an indefinite article. That is, is the word passed "certain", "few", "many", "more", "several", or "some"?

IsDemonstrative( ) is called to determine whether the word passed to it is a demonstrative. That is, is the word passed "this", "that", "these", or "those"?

IsToBe( ) is called to determine whether the word passed to it is a form of the verb "to be". That is, is the word passed "am", "are", "is", "was", or "were"?

IsToBeNot( ) is called to determine whether two adjacent words passed to it are a negated conjugated form of the verb "to be". That is, are the words "am not", "are not", "is not", "was not", or "were not"?

IsToBeNotCtract( ) is called to determine whether the word passed to it is a negated form of the verb "to be" contracted. That is, is the word "ain't", "aren't", "isn't", "wasn't", or "weren't"?

IsToBeEquiv( ) is called to determine whether the word passed to it is an equivalent form of the verb "to be". That is, is the word "appear", "become", "feel", "look", "seem", "smell", "sound", or "taste", or a form thereof, e.g. "appears" or "felt"?

IsToHave( ) is called to determine whether the word passed to it is a conjugated form of the verb "to have". That is, is the word "have", "has", or "had"?

IsToHaveNot( ) is called to determine whether the words passed to it are a negated conjugated form of the verb "to have". That is, are the words "have not", "has not", or "had not"?

IsToHaveNotCtract( ) is called to determine whether the word passed to it is a negated contracted form of the verb "to have". That is, is the word "haven't", "hasn't", or "hadn't"?

IsToDo( ) is called to determine whether the word passed to it is a conjugated form of the verb "to do". That is, is the word "do", "does", or "did"?

IsToDoNot( ) is called to determine whether the two adjacent words passed to it are a negated conjugated form of the verb "to do". That is, are the words passed to it "do not", "does not", or "did not"?

IsToDoNotCtract( ) is called to determine whether the word passed to it is a negated contracted form of the verb "to do". That is, is the word "don't", "doesn't", or "didn't"?

IsPrepG1( ) is called to determine whether the word passed to it is a preposition from Group 1. That is, is the word "for", "from", "in", "of", "off", "on", "over", "with", or "without"?

IsPrepG2( ) is called to determine whether the word passed to it is a preposition from Group 2. That is, is the word "around", "away", "by", "close", "far", "in", "near", "next", "for", "off", "with", or "within"?

IsPersPronoun( ) is called to determine whether the word passed to it is a personal pronoun. That is, is the word "I", "you", "he", "she", "it", "we", or "they"?

Is PossessiveP( ) is called to determine whether the word passed to it is a possessive pronoun. That is, is the word "my", "your", "his", "her", "its", "our", or "their"?

IsIndefPronounG1( ) is called to determine whether the word passed to it is an indefinite pronoun from Group 1. That is, is the word "all", "both", "certain", "few", "many", "several", or "some"?

IsIndefPronounG2( ) is called to determine whether the word passed to it is an indefinite pronoun from Group 2. That is, is the word "little", "more", "or "much"?

IsImpIndObj( ) is called to determine whether the word passed to it is an impersonal indirect object. That is, is the word "me", "you", "him", "her", "it", "us", or "them"?

IsAux( ) is called to determine whether a word is an auxiliary. That is, is the word "can", "could", "might", "must", "shall", "should", "will", or "would".

IsAuxNot( ) is called to determine whether the words passed to it are a negative auxiliary combination. That is, are the words "could not", "might not", "shall not", "should not", "will not", or "would not"?

IsAuxNotCtract( ) is called to determine whether the word passed to it is a negated auxiliary contracted. That is, is the word "cannot", "can't", "couldn't", "mustn't", "shan't", "shouldn't", "won't", or "wouldn't"?

IsModifierG1( ) is called to determine whether the word passed to it is a modifier from Group 1. That is, is the word "so", "too", "or "very"?

IsModifierG2( ) is called to determine whether the word passed to it is a modifier from Group 2. That is, is the word passed to it "few", "little", "many", or "much"?

IsModiferG3( ) is called to determine whether the word is a modifier from Group 3. That is, is the word "never" or "quite"?

IsAdverb( ) is called to determine whether the word passed to it is an adverb.

Homograph Rules

The naming convention for each homograph rule function is comprised of four pieces of text information. First, the word "Apply" is used to indicate that when the function is called, a rule is being applied. Second, an indication is given as to what type of rule the function represents: special, certainty, or probable. Third, identification of the part of speech for the first word of the proposition pair under test is given, i.e. "Verb", "Noun", "Adj", or "Past". Finally, the fourth textual part of the function name is a single letter indicating the part of speech for the second word of the proposition pair, i.e. "V", "N", "A", or "P". Other naming conventions may also be used. Once a called rule function has completed its execution, the function returns a value to the routine from which it was called which indicates whether or not the rule was satisfied. The returned value is central to the filter engine's determination of whether or not to apply additional rules.

ApplySpecialAdjN( ) is called to determine whether the homograph is being used in its adjective or noun form in accordance with a special case coded into the function. For example, if the homograph "minute" is followed by "amount", then "minute" is being used as an adjective.

ApplySpecialAdjV( ) is called to determine whether the homograph is being used in its adjective or verb form in accordance with special cases coded into the function. For example, if the homograph "live" is followed by "from" or "via", then "live" is being used as an adjective. If the homograph "close" is followed by "to", "close" is being used as an adjective. If the any of the homographs "close", "live" or "perfect" are preceded by a definite article, the homograph is being used as an adjective.

ApplySpecialNounV( ) is called to determine whether the homograph is being used in its noun or verb form in accordance with special cases coded into the function. For example, if the homograph "tear" is followed by "gas", then utear" is being used as part of the noun "tear gas", and is pronounced like "teer". If "tear" is preceded by "wear and", then "tear" is being used as part of the common noun phrase "wear and tear", and is pronounced like "tare". If the homograph "lead" is followed by "foot", "pencil", or "out", then "lead" is pronounced like "led".

ApplySpecialVerbA( ) is called to determine whether the homograph is being used in its verb or adjective form in accordance with special cases coded into the function. For example, if the homograph "live" is followed by a preposition, then "live" is being used as a verb.

ApplySpecialVerbN( ) is called to determine whether the homograph is being used in its verb or noun form in accordance with special cases coded into the function. For example, if the homograph "wind" is followed by "up" or "down", then "wind" is being used as a verb.

ApplyCertPastV( ) is called to determine whether the homograph is being used in its past participle or verb form in accordance with certain cases coded into the function and application of the general rules. For example, if the homograph is preceded by a version of the verb "to have", or by "he", "she", or "it", then the homograph is being used as a past participle.

ApplyCertAdjN( ) is called to determine whether the homograph is being used in its adjective or noun form in accordance with certain cases coded into the function and application of the general rules. For example, if the homograph is preceded by a version of the verb "to be", or its equivalent, and it does not end in "s", then the homograph is being used as an adjective. If the homograph is preceded by a personal pronoun and the personal pronoun is preceded by a version of the verb "to be" and does not end in "s", then the homograph is being used as an adjective. If the homograph is preceded by the word "so" or "too", then the homograph is being used as an adjective. If the homograph is preceded by the word "never" or "quite", then the homograph is being used as an adjective.

ApplyCertAdjV( ) is called to determine whether the homograph is being used in its adjective or verb form in accordance with certain cases coded into the function and application of the general rules. For example, if the homograph is preceded by a version of the verb "to be" and does not end in "s", the homograph is being used as an adjective. If the homograph is preceded by "so", "too" or "very", then the homograph is being used as an adjective. If the homograph is preceded by a Group 2 Modifier and the Group 2 Modifier is preceded by a Group 1 Modifier, then the homograph is being used as an adjective.

ApplyCertNounA( ) is called to determine whether the homograph is being used in its noun or adjective form in accordance with certain cases coded into the function and application of the general rules. For example, if the word ends in "s", then the word is a noun.

ApplyCertNounV( ) is called to determine whether the homograph is being used in its noun or verb form in accordance with certain cases coded into the function and application of the general rules. For example, if the homograph is preceded by a definite article, then the homograph is being used as a noun. If the homograph is followed by a version of the verb "to be" or "to have", then the homograph is being used an a noun. If the homograph is followed by an auxiliary word, then the homograph is being used a noun. If the homograph is preceded by a Group 1 Preposition, then the homograph is being used as a noun. If the homograph is preceded by a possessive pronoun, then the homograph is being used as a noun. If the homograph is preceded by the word "whose", then the homograph is being used as a noun. If the homograph is followed by a version of the verb "to do", then the homograph is being as a noun. Finally, if the homograph is preceded by a Group 1 Indefinite pronoun, then the homograph is being as a noun.

ApplyCertVerbA( ) is called to determine whether the homograph is being used in its verb or adjective form in accordance with certain cases coded into the function and application of the general rules. For example, if the homograph is preceded by a form of an auxiliary word, then the homograph is being used as a verb. If the homograph has a "s" ending, then the homograph is being used as a verb.

ApplyCertVerbN( ) is called to determine whether the homograph is being used in its verb or noun form in accordance with certain cases coded into the function and application of the general rules. For example, if the homograph is preceded by a personal pronoun, then the homograph is being as a verb. If the homograph is preceded by some form of an auxiliary word, then the homograph is being used as a verb. If the homograph is followed by an impersonal indirect object, then the homograph is being used as a verb. If the homograph is followed by a definite or indefinite article, then the homograph is being used as a verb. If the homograph is followed by a possessive pronoun, then the homograph is being used as a verb. If the homograph is preceded by the word "who" or "lets", then the homograph is being used as a verb. Finally, if the homograph is preceded by a version of the verb "to do", then the homograph is being used as a verb.

ApplyProbAdjN( ) is called to determine whether the homograph is probably being used in its adjective or noun form in accordance with probable cases coded into the function and application of the general rules. For example, if the homograph is followed by a word which is not an adverb or a personal pronoun and that word is followed by some form of the verb "to be" or "to have" or "to do" or a form an auxiliary word, then the homograph is probably being used as an adjective. If the homograph is preceded by the word "very" and "very" is preceded by either a definite article or demonstrative, then the homograph is probably being used as an adjective.

ApplyProbAdjV( ) is called to determine whether the homograph is probably being used in its adjective or verb form in accordance with probable cases coded into the function and application of the general rules. For example, if the homograph is followed by a word which is not an adverb and that word is followed by a verb, then the homograph is probably being used as an adjective. ApplyProbNounVO is called to determine whether the homograph is probably being used in its noun or verb form in accordance with probable cases coded into the function and application of the general rules. For example, if the homograph is preceded by a demonstrative or an indefinite pronoun from Group 1 or Group 2 then the homograph is probably being used as a noun.

ApplyProbVerbA( ) is called to determine whether the homograph is probably being used in its adjective or noun form in accordance with probable cases coded into the function and application of the general rules. This function passes a series of parameters to the ApplyProbVerbN( ) function to aid in determining whether the homograph is probably being used as a verb or an adjective.

ApplyProbVerbN( ) is called to determine whether the homograph is probably being used in its verb or noun form in accordance with probable cases coded into the function and application of the general rules. For example, if the homograph is preceded by the word "to", then the homograph is probably being used as a verb. If the homograph is followed the word "this" or "that" then the homograph is probably being used as a verb. If the homograph is at the start of a sentence or followed by a carriage return or followed by a new line and is not followed by punctuation and does not end in "s", then the homograph is probably being used as a verb. If the homograph is preceded by the word "which", where "which" is the first preceding word or second preceding word, then the homograph is probably being used as a verb.

A software implementation of the above described embodiments may comprise a series of computer instructions either fixed on a tangible medium, such as a computer readable media, e.g. diskette 142, CD-ROM 147, ROM 115, or fixed disk 152 of FIG. 1, or transmittable to a computer system, via a modem or other interface device, such as communications adapter 190 connected to the network 195 over a medium 191. Medium 191 can be either a tangible medium, including but not limited to optical or analog communications lines, or may be implemented with wireless techniques, including but not limited to microwave, infrared or other transmission techniques. The series of computer instructions embodies all or part of the functionality previously described herein with respect to the invention. Those skilled in the art will appreciate that such computer instructions can be written in any of a number of programming languages for use with many computer architectures or operating systems. Further, such instructions may be stored using any memory technology, present or future, including, but not limited to, semiconductor, magnetic, optical or other memory devices, or transmitted using any communications technology, present or future, including but not limited to optical, infrared, microwave, or other transmission technologies. It is contemplated that such a computer program product may be distributed as a removable media with accompanying printed or electronic documentation, e.g., shrink wrapped software, preloaded with a computer system, e.g., on system ROM or fixed disk, or distributed from a server or electronic bulletin board over a network, e.g., the Internet or World Wide Web.

Although various exemplary embodiments of the invention have been disclosed, it will be apparent to those skilled in the art that various changes and modifications can be made which will achieve some of the advantages of the invention without departing from the spirit and scope of the invention. It will be obvious to those reasonably skilled in the art that other components performing the same functions may be suitably substituted. Further, the methods of the invention may be achieved by using other software implementations, using the appropriate processor instructions, or in hybrid implementations which utilize a combination of hardware logic and software logic to achieve the same results. Such modifications to the inventive concept are intended to be covered by the appended claims.

What is claimed is:

1. A computer program product for use with a computer system capable of converting text data into synthesized speech, the computer program product comprising a computer useable medium having program code embodied in the medium and configured to determine a preferred pronunciation of a homograph in the text data, the program code further comprising:

program code which examines the text data to identify the homograph within the text data and to extract words surrounding the identified homograph in the text data;

program code responsive to the identified homograph which identifies the possible parts of speech that the identified homograph can assume;

program code responsive to the possible parts of speech that the identified homograph can assume that obtains a set of rules, each rule based on a pair of possible parts of speech of the identified homograph and a word order and position of one of the surrounding words;

program code which sequentially applies the rules in the obtained rule set until a rule is satisfied to determine a part of speech for the homograph in the text data; and program code which is responsive to the homograph and the determined part of speech usage for determining a preferred pronunciation for the identified homograph.

2. The computer program product of claim 1 wherein the program code configured to identify a homograph comprises:

program code configured to identify selected portions of the text data.

3. The computer program product of claim 2 wherein the program code configured to identify selected portions of the text data comprises:

program code configured to parse the text data; and program code configured to delineate the text data into phrases.

4. The program code of claim 3 wherein the program code configured to delineate further comprises:

program code configured to identify punctuation characters peculiar to the natural language of the text data.

5. The computer program product of claim 2 wherein the program code configured to identify a homograph comprises:

program code configured to compare the selected portions of the text data with a predefined list of homographs.

6. The computer program product of claim 1 wherein the program code for determining the preferred pronunciation comprises:

program code configured to modify the text data to indicate the preferred pronunciation of the identified homograph.

7. The computer program product of claim 6 wherein the program code configured to modify comprises:

program code configured to insert data defining the preferred pronunciation of the identified homograph into the text data.

8. The computer program product of claim 7 wherein the program code configured to insert comprises:

program code configured to substitute the identified homograph within the text data with data, comprehendible by the speech synthesizer, representing the preferred pronunciation of the identified homograph.

9. The computer program product of claim 1 wherein the program code which obtains the set of rules comprises program code which obtains an attribute table listing possible parts of speech for the identified homograph and a set of rules for each proposition pair of possible homograph parts of speech.

10. The computer program product of claim 9 wherein the set of rules are arranged in a predetermined order based on the identified homograph.

11. The computer program product of claim 10 wherein the program code which applies the rules applies the rules in the predetermined order.

12. The computer program product of claim 1 wherein the program code which determines a preferred pronunciation for the identified homograph retrieves the preferred pronunciation from a phonetic table.

13. A method for use with a computer system capable of converting text data into synthesized speech, the method comprising:

A. examining the text data to identify the homograph within the text data and to extract words surrounding the identified homograph in the text data;

B. using the identified homograph to identify the possible parts of speech that the identified homograph can assume;

C. using the possible parts of speech that the identified homograph can assume to obtain a set of rules, each rule based on a pair of possible parts of speech of the identified homograph and a word order and position of one of the surrounding words;

D. sequentially applying the rules in the obtained rule set until a rule is satisfied to determine a part of speech for the homograph in the text data; and E. using the identified homograph and the determined part of speech usage for determining a preferred pronunciation for the identified homograph.

14. The method of claim 13 wherein step A comprises:

A.1 parsing the text data into phrases;

A.2 delineating the phrases by punctuation characters.

15. The method of claim 14 wherein step A2 further comprises:

A.2.1 comparing the parsed phrases with a predetermined list of punctuation characters.

16. The method of claim 13 wherein step A comprises:

A.1 parsing the text data into phrases; and

A.2 comparing the parsed phrases with a predetermined list of homographs.

17. The method of claim 13 wherein step D comprises:

D.1 modifying the text data to indicate the preferred pronunciation of the identified homograph.

18. The method of claim 17 wherein step D.1 further comprises the steps of:

D.1.1 inserting data, understandable by the speech synthesizer, representing the preferred pronunciation of the identified homograph; and D.1.2 deleting the identified homograph from the text data.

19. The method of claim 13 wherein step B further comprises the steps of:

B.1 associating the identified homograph with an entry of an attribute table.

20. The method of claim 19 wherein step B further comprises the step of:

B.2 determining from the identified entry of the attribute table which grammatical function of language the homograph can perform.

21. The method of claim 20 wherein step B further comprises the step of:

B.3 performing a syntactic analysis of the identified homograph within the text.

22. The method of claim 21 wherein step B.3 further comprises the steps of:

B.3.1 analyzing the word order of the homograph within the text; and

B.3.2 analyzing the position of the homograph within the text.

23. The method of claim 20 wherein step B further comprises the step of:

B.3 performing the semantic analysis of the homograph within the text.

24. The method of claim 20 wherein step B further comprises the step of:

B.3 performing statistical analysis of the homograph within the text.

25. The method of claim 24 wherein step B.3 further comprises the step of:

B.3.1 determining from the identified entry for the homograph in the attribute table the preferred pronunciation from a statistics bit.

26. Apparatus for use with a computer system capable of converting text data into synthesized speech, the apparatus comprising:

a parser which examines the text data to identify the homograph within the text data and to extract words surrounding the identified homograph in the text data;

an attribute retriever responsive to the identified homograph which identifies the possible parts of speech that the identified homograph can assume;

a rules mechanism that uses the possible parts of speech that the identified homograph can assume and obtains a set of rules, each rule based on a pair of possible parts of speech of the identified homograph and a word order and position of one of the surrounding words;

a rules engine which sequentially applies the rules in the obtained rule set until a rule is satisfied to determine a part of speech for the homograph in the text data; and a lookup mechanism which is responsive to the homograph and the determined part of speech usage for determining a preferred pronunciation for the identified homograph.

27. The apparatus of claim 26 wherein the attribute retriever comprises a mechanism which obtains an attribute table listing possible parts of speech for the identified homograph and a set of rules for proposition pairs of each possible homograph part of speech.

28. The apparatus of claim 27 wherein the set of rules are arranged in a predetermined order based on the identified homograph.

29. The apparatus of claim 28 wherein the rules engine applies the rules in the predetermined order.

30. The apparatus of claim 26 wherein the lookup mechanism retrieves the preferred pronunciation from a phonetic table.

31. A computer data signal embodied in a carrier wave for use with a computer system capable of converting text data into synthesized speech, the computer data signal comprising:

program code which examines the text data to identify the homograph within the text data and to extract words surrounding the identified homograph in the text data;

program code responsive to the identified homograph which identifies the possible parts of speech that the identified homograph can assume;

program code that uses the possible parts of speech that the identified homograph can assume and obtains a set of rules, each rule based on a possible pair of parts of speech of the identified homograph and a word order and position of one of the surrounding words;

program code which sequentially applies the rules in the obtained rule set until a rule is satisfied to determine a part of speech for the homograph in the text data; and program code which is responsive to the homograph and the determined part of speech usage for determining a preferred pronunciation for the identified homograph.

32. The computer data signal of claim 31 wherein the program code which obtains the set of rules comprises program code which obtains an attribute table listing possible parts of speech for the identified homograph and a set of rules for each proposition pair of possible homograph parts of speech.

33. The computer data signal of claim 32 wherein the set of rules are arranged in a predetermined order based on the identified homograph.

34. The computer data signal of claim 33 wherein the program code which applies the rules applies the rules in the predetermined order.

35. The computer data signal of claim 31 wherein the program code which determines a preferred pronunciation for the identified homograph retrieves the preferred pronunciation from a phonetic table.

* * * * *

Disclaimer 6,098,042—Duy Quoc Huynh, Cedar Park, Tex. HOMOGRAPH FILTER FOR SPEECH SYNTHESIS SYSTEM. Patent dated August 1, 2000. Disclaimer filed October 30, 2000, by the assignee, International Business Machines Corporation.

Hereby enters this disclaimer to claims 1-35 of said patent.

*(Official Gazette, March 6, 2001)*